United States Patent [19]

Mozley

[11] Patent Number: 5,037,373

[45] Date of Patent: Aug. 6, 1991

[54] SOLIDS-LIQUIDS SEPARATOR

[75] Inventor: Richard H. Mozley, Falmouth, England

[73] Assignee: Richard Mozley Limited, Cardrew, United Kingdom

[21] Appl. No.: 430,429

[22] Filed: Nov. 2, 1989

[51] Int. Cl.[5] ..... B04B 11/08

[52] U.S. Cl. ..... 494/55; 494/45

[58] Field of Search ..... 494/52, 53, 54, 55, 494/56, 57, 58, 59, 45; 210/781, 782, 360.1

[56] References Cited

U.S. PATENT DOCUMENTS 2,174,857 10/1939 Jorgensen ..... 494/54

FOREIGN PATENT DOCUMENTS 548955 4/1932 Fed. Rep. of Germany ..... 494/52

*Primary Examiner*—Robert W. Jenkins

*Attorney, Agent, or Firm*—Needle & Rosenberg

[57] ABSTRACT

A centrifugal solids-liquids separator comprises a rotatable hollow centrifuge drum at least a part of which is tapered, and which is rotatable about its axis, means for introducing a slurry of solids and liquids to be separated at a point along the length of the drum spaced from a wider end so that rotation of the drum tends to cause migration of the slurry towards the said wider end, and scraper conveyor means rotatable about an axis coincident with that of the drum and at a relative speed which is low in relation to the absolute speed of the drum, the scraper conveyor means being so mounted that they act in direct contact with the inside surface of the drum so as to displace solids contacted thereby towards the narrow end of the drum against the axial force induced by the rotation.

16 Claims, 3 Drawing Sheets

SOLIDS-LIQUIDS SEPARATOR

BACKGROUND OF THE INVENTION

The separation of solids from liquids creates many problems in obtaining both adequate separation of the solids and the liquids and at the same time an adequately long service life of the equipment without an unnecessarily high consumption of power during operation. One known centrifugal separator for this purpose, which is adapted for separating, for example, water from a slurry of solid particles in water, comprises a rotatable imperforate hollow centrifuge drum at least a part of which is tapered and the axis of which coincides with the axis of rotation of the drum, a conveyor coaxially located within the centrifuge drum and itself rotatable in the same direction as the centrifuge drum at a speed above or below that of the centrifuge drum such that the differential speed of the two is small in relation to the absolute speed of rotation thereof whereby to convey material in the space between the drum and the conveyor axially thereof as a result of the differential speed of rotation towards the narrow end of the tapered part of the drum, and means for introducing a solids-liquids mixture to be separated into the said space.

In such known equipment the conveyor may comprise a scroll (by which term is meant a continuous helical screw conveyor) or a plurality of individual blades and, in this latter case, each individual blade acts in the same way as an elementary portion of the scroll to displace the solids fraction axially: as will be appreciated, under the centrifugal action of the rotating drum the denser solids particles in the solids-liquids mixture to be separated migrate radially outwardly towards the surface of the drum and the liquid forms a pool at the wider end of the drum which, conventionally, incorporates a right-circular cylindrical portion maintained by a radially inwardly directed lip forming a weir over which the liquid flows for collection in a launder.

One of the problems encountered in operating known such centrifugal separating apparatus lies in the fact that, due to the difficulty of obtaining sufficiently precise manufacturing tolerances, the scraper blades are usually a clearance fit within the drum so that there is a narrow space between the active edge of the blade and the surface of the drum in which a thin film of solid particles can collect. This layer of particles, termed the "heel" is effectively pinned to the surface of the drum by the centrifugal action thereof and is not subjected to the axial displacement of the blades which pass over it. The surface roughness of this layer of material is, however, very high and, furthermore, new solids particles which are continually being introduced to the drum during use build up onto this layer so that the blades have to exert a shearing action separating freshly-settled particles of the solids layer from the "heel" and this causes very heavy wear on the blades themselves so that they have an extremely short service life even if made from a highly wear-resistant material such as silicon carbide.

OBJECTS OF THE INVENTION

The primary object of the present invention is to provide a centrifugal solids-liquid separator in which the problems of heavy wear and high power consumption are simultaneously mitigated by a novel configuration.

It is another object of the invention to provide a centrifugal separator which, unlike conventional separators which have to be operated at high speed (speeds in the region of 1,000 rpm and higher are not uncommon) can be operated satisfactorily at relatively low speeds.

A further objection of the invention is to provide apparatus which, because it will effectively separate the solids fraction from the liquid fraction at very much lower speeds of rotation in accordance with the preceding object, does not require the sophisticated engineering techniques which were previously required for very high speed operation of conventional centrifugal separators.

SUMMARY OF THE INVENTION

According to one aspect of the present invention, therefore, a centrifugal solids-liquids separator comprises a rotatable hollow centrifuge drum, means for rotating the drum about its axis, and means for introducing a slurry of the solids and liquid(s) to be separated at an intermediate point along the length of the drum, the configuration and/or orientation of the drum being such that an axial force along the drum is exerted on the slurry urging it towards one end of the drum, and scraper conveyor means rotatable about an axis coincident with that of the drum and at a relative speed which is low in relation to the absolute speed of rotation of the drum (greater or less than that of the drum), characterised in that the scraper means are so mounted that they act in direct contact with the inside surface of the drum to displace solid particles contacted thereby towards the end of the drum opposite the said one end thereof and against the said axial force acting on the slurry within the drum.

Direct contact of the scraper blades with the drum surface prevents the build up of a "heel" of compacted solids so that the scrapers are not heavily worn in use by contact between their sliding surface and the surface of the heel. For this to operate satisfactorily the scraper means must be capable of radial displacement to accommodate variations both due to manufacturing tolerances (that is differences in the dimensions of individual blades and/or their mounts as well as any non-circularity of the drum surface at the point of contact with the blade) and also to accommodate variations occuring during use because of differential wear of the blades and/or the drum: additionally, varying radial forces may be caused by variations in the density and/or relative proportions of the slurry. In order to enable the scraper conveyor means to meet the requirements outlined above the scraper conveyor means preferably comprises a plurality of individual scraper blades mounted so as to be individually radially displaceable with respect to the inner surface of the drum such that they are held in direct contact therewith by the centrifugal forces exerted upon rotation of the drum and conveyor combination.

In a preferred embodiment of the invention the scraper blades are rockable about an axis generally perpendicular to a plane including the axis of rotation of the said scraper conveyor means and passing through the point of connection of the blade to a blade carrier member. Such rocking action allows differential wear along the length of each blade to be accommodated so that the major part of the sliding surface of the blade can remain in contact with the inside surface of the drum despite differential wear thereof. In this preferred embodiment the scraper blades are secured in position by resilient connectors permitting such relative rocking movement about the said axis. The relative rocking movement may additionally be permitted about any axis perpendicular to the said radial line.

The sliding surface of each blade preferably forms part of a helix and each blade may itself be formed as a substantially flat member having an arcuately curved sliding surface. The plane of the major face of each blade thus lies at an angle inclined to a radial plane of the drum and the angle of inclination determines the effective pitch of the helix. The blades may be mounted so as to be adjustable whereby to vary the pitch of the helix and this may conveniently be achieved by mounting each blade so as to be turnable about an axis extending radially with respect to the axis of rotation of the scraper blade assembly as a whole, with abutment stop means for determining the inclination of the blades as they are rotated. Each blade is thus carried by the pivotal connection to a blade carrier member at or adjacent a leading edge of the blade and its angle of inclination determined by contact with the abutment member at or adjacent the trailing edge of the blade. In the preferred embodiment, then, each blade has effectively four degrees of freedom and its working position is determined by contact between the sliding surface of the blade and the inner surface of the drum, the connection between the blade and the blade carrier member, and the contact between the blade and the adjustable abutment member. An increased radial force may be exerted on the drum by the scraper blades if they are provided with additional weights the position of which may be varied whereby to vary the weight distribution of the blade as a whole.

It has been found that considerable wear resistance may be achieved by making the scraper blades from a resiliently flexible material rather than a hard rigid material such as would conventionally be employed where a high wear resistance is required. The drum-contacting sliding surface of the scraper blade may thus be made from, for example, a polyurethane, although other materials, in particular more conventional wear resistant materials such as silicon carbide may also be used within the scope of the invention.

According to another aspect of the present invention a centrifugal solids-liquids separator comprises a rotatable hollow centrifuge drum, means for rotating the drum about its axis, and means for introducing a slurry of the solids and liquids to be separated at a point along the length of the drum spaced from one end thereof such that rotation of the drum tends to cause migration of the slurry towards the said one end, characterised in that there are provided scraper means mounted so as to be in direct contact with the interior surface of the drum and the interior surface of the drum itself is formed as a lining having a smooth inner surface. The lining may, for example, be made from a wear resistant material which is itself resiliently flexible, such as polyurethane, and in a preferred embodiment of the invention the lining is cast in place in the drum by rotating this whilst holding its axis at a shallow angle to the horizontal.

According to another aspect of the present invention a centrifugal solids-liquids separator comprises a rotatable hollow centrifuge drum which, unlike conventional separator or classifier drums, has a small, or even no, radially inwardly directed lip at the ends thereof such that when the drum is rotated and a slurry of solids and liquid(s) to be separated is introduced thereto a thin film of substantially constant thickness along the axial length of the drum forms on the inner surface thereof, and means for causing an axial force to be exerted on the slurry introduced thereto. In this aspect the present invention may be considered to comprise a centrifuge drum which is substantially devoid of means for causing a radial inward build up of slurry or separated liquid. This differs from conventional centrifuging techniques used for example for clarification or dewatering of a solids-liquids mixture in which it is usual to form what is termed a "clarifying pool" by the use of a relatively wide radially inwardly directed lip which acts to retain a relatively thick layer of liquid in the vicinity of the wide end of the drum to cause this to remain within the centrifuge for a longer time period giving a greater time for the solids to separate from the liquid by the centrifugal action. A centrifugal separator formed in accordance with this aspect of the invention preferably also incorporate scrapers of a type such as those defined hereinabove.

In order to separate the solids fraction from the liquid fraction some means of causing the solids to be displaced axially against the axial force acting on the slurry are required and this preferably takes the form of a scraper conveyor comprising a plurality of separate blades.

The axial force on the slurry may be exerted in one of a number of ways. If the centrifuge drum is a right circular cylindrical drum the axial force may be applied simply by mounting the drum with its axis vertical so that the slurry is acted on by gravity, in which case the speed of rotation of the drum in use must be adapted to the nature of the slurry and the diameter of the drum so as to control the rate of descent of the liquid fraction of the slurry whilst causing the solid fraction to rise by means of scrapers. Orientation of the drum with its axis vertical, on the other hand, would require a relatively high speed of rotation which it is preferable to avoid in order to avoid the above-discussed problems of high speed rotation. This can be achieved by orientating a cylindrical drum with its axis inclined at a shallow angle so that the axial force on the slurry along the length of the drum is determined by the component of gravity acting in that direction. In another embodiment, however, the drum may be made as a tapered drum, in which case the axial force on the slurry is created by the speed or rotation of the drum and, if the drum axis is vertical, may act in the opposite direction from gravity (assuming that the wide end of the drum is uppermost) whilst the scraper conveyor may be operated to scrape the solids fraction downwardly towards the narrow end.

According to a further aspect of the present invention a centrifugal solids-liquids separator comprises a rotatable hollow centrifuge drum at least a part of which has a shallow taper (and herein the term "shallow taper" will be understood to mean a taper of not substantially more than 2° or 2.5° half-angle of a cone with a maximum practical value of not more than 5°), means for rotating the drum about its axis and means for introducing a slurry of solids and liquid(s) to be separated into the interior of the drum at a point spaced from the wider end thereof whereby to form a relatively thin film of slurry having a substantially constant thickness along the axis of the tapered portion of the drum, means for displacing the solids component of the slurry axially at least in discrete steps towards the narrow end of the drum, and means for introducing additional wash liquid whereby to enhance separation of the solids from the thin film of slurry formed on the drum surface. Such wash liquid may serve to displace fine particles of solids when classifying or may serve to wash the solids being scraped free from any contaminants which are soluble in the liquid. Often this liquid may simply be water although other solvent liquids may be used.

Whatever the form of the drum or the orientation of its axis the apparatus of the present invention may include a radially extending slurry delivery duct which is rotated at the same speed as the drum or the scraper conveyor whereby to cause circumferential acceleration of the slurry as it is introduced to the inside surface of the drum thereby reducing the circumferential acceleration which the drum must impart to the slurry.

In embodiments of the invention incorporating a plurality of scraper blades as referred to above these may be mounted in sets on generally axially extending bars each of which is radially displaceable to accommodate variations in the load imposed by the slurry, particularly the solids fraction thereof, during use. In embodiments in which wash water is additionally introduced into the interior of the drum this may be introduced axially through a central member which carries the scraper blade support arms or through a central axial duct passing therethrough.

Other features and advantages of the invention will become apparent from a study of the following detailed description, in which reference will be made to the accompanying drawings, which is given purely by way of non-limitative example.

DESCRIPTION OF THE PREFERRED EMBODIMENTS

Figure 1:
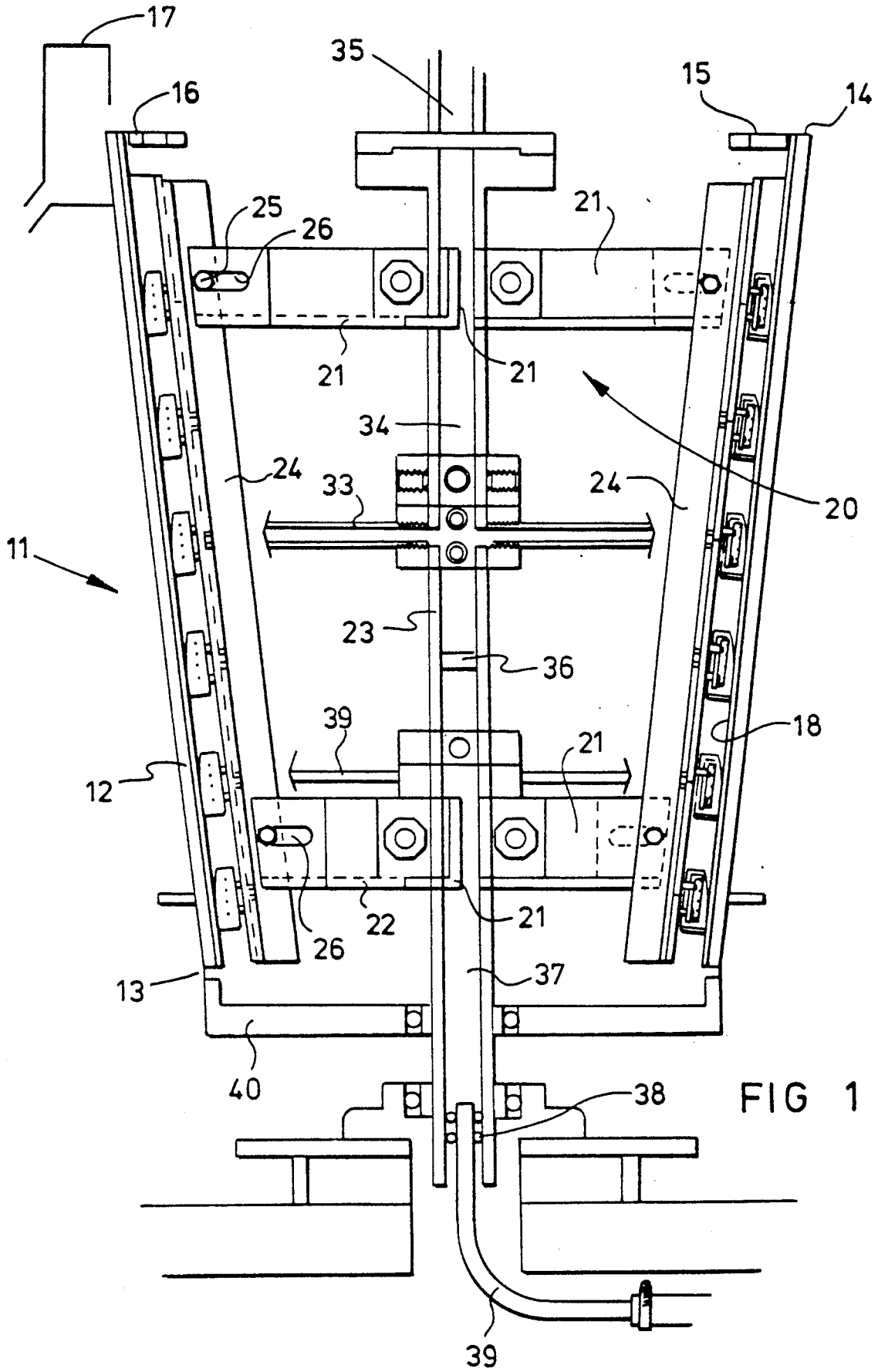
FIG. 1 is an axial sectional view through a first embodiment of the invention.
Figure 2A:
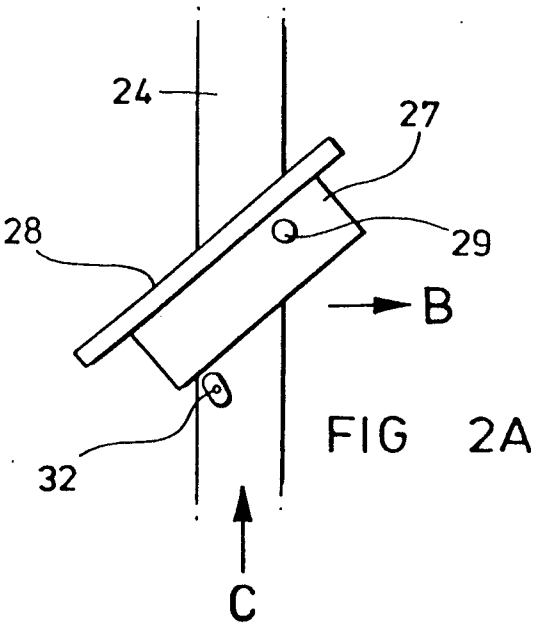
FIG. 2*a* is a view of a detail of the embodiment of the invention seen in the direction of the arrow A of FIG. 2.
Figure 2:
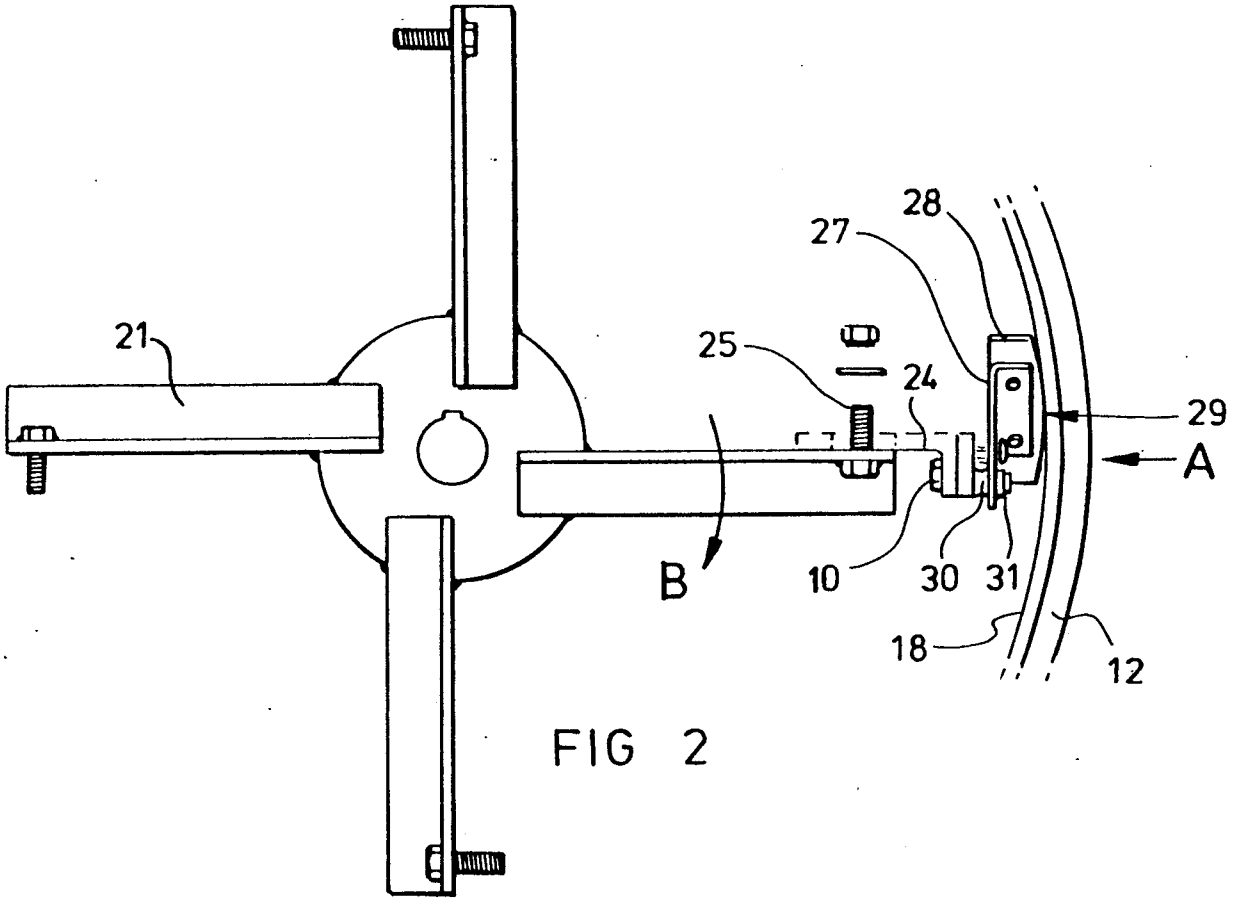
FIG. 2 is a plan view from above of a part of the embodiment illustrated in FIG. 1.

Referring first to FIGS. 1 and 2 of the drawings there is shown a centrifugal solids-liquids separator in schematic form with parts thereof not necessary for the explanation of the present invention omitted. The separator, generator indicated by the reference numeral 11 comprises a conically tapered drum 12 having a narrow end 13 and a wide end 14 the latter of which has a radially inwardly directed reinforcing flange 15 with apertures 16 therein which allow liquids displaced axially toward the wide end of the drum 12 to flow therethrough to a launder 17 only schematically illustrated in FIG. 1, without creation of a weir pool. The taper angle of the drum 12 has been exaggerated in FIG. 1 for clarity, but in practice the half-angle between the axis and the side wall of the drum is very shallow, typically 1°, and not greater than about 2 to 2.5°. The drum 12 is provided with means (not shown) by which it can be rotated at a speed typically in the region of between 200 and 250 revolutions per minute. The drum 12 is imperforate and has an interior lining 18 of polyurethane cast in situ so as to have a very smooth inner surface. The lining 18 may be cast within the drum 12 by introducing the polyurethane in a liquid uncured state whilst rotating the drum with its axis of rotation at a shallow angle to the horizontal, typically in the region of 8° and at a speed of rotation of about 190 rpm. This is continued until the polyurethane has cured to a sufficiently solid state to be capable of retaining its shape when the rotation is ceased.

Within the drum 12 is a scraper assembly generally indicated 20 comprising two sets of radial arms 21, 22 mounted on a central hollow rotating member 23 which is rotatably driven by means not shown at a speed similar to but slightly different from that of the drum 12. The radial arms 21, 22 carry opposite ends of respective scraper mount bars 24 which are loosely linked to the arms 21, 22 by shouldered bolts 25 within slots 26 in the arms 21, 22 which allow the bars 24 to move radially with respect to the arms 21, 22. Each of the bars 24 is identical and carries a set of six scraper blades which will be described in more detail below with reference only to one blade.

As will be seen from FIG. 2 the scraper blade shown comprises a blade body 27 which is L-shaped in cross-section to which is mounted a resiliently flexible blade 28 having a curved sliding surface 29 in contact with the inner lining 18 of the drum 12 shown schematically in FIG. 2. The blade body 27 is fixed to the blade carrier bar 24 by a resilient connector comprising a bolt 10 passing through an opening in the blade carrier bar 24 and a corresponding opening in the blade body 27 with the interposition of two resilient grommets 30, 31 which are held under slight compression by the bolt 10. It will be appreciated that the aperture in the blade body 27 through which the bolt 10 passes has a diameter rather larger than that of the bolt 10 such that movements of the blade body 27 about any axis passing through the centre of this hole can take place over a limited range. Thus, in use, when the blade assembly 20 is rotated at the speed referred to above centripetal forces acting on the blade 27, 28 cause this to be urged radially outwardly to press the sliding surface 29 into contact with the lining 18 of the drum 12.

As will be seen from FIG. 2A the precise inclination of the blade 28 with respect to the blade carrier bar 24 is determined by adjustment of a cam 32 carried on the blade carrier bar 24 and engaged by one edge of the blade body 27. It will be appreciated that in use of the separator described above the blade assembly 20 will be rotated at a speed slightly different from that of the drum 12 so that the blades effectively travel in the direction of the arrow B of FIG. 2 in relation to the drum, which arrow is also shown in FIG. 2A. As the scraper blade 28 moves in relation to the drum 12 the forces exerted on it by the solids fraction of the slurry caused to migrate radially into contact with the inner surface lining 18 would cause the blade 28 to rotate in the anticlockwise direction as viewed in FIG. 2A and this movement is resisted by the cam 32 the adjustment of which about its own axis adjusts the precise inclination of the blade 28 with relation to the blade carrier bar 24.

Returning now to FIG. 1, the central hollow member 23 has a set of four radial arms 33 in communication with the hollow interior 34 thereof for the delivery of slurry, introduced through the upper end 35 of the hollow member 23 to the interior of the drum 12 at a midpoint. A plug 36 separates the upper hollow portion of the member 23 from a lower hollow portion 37 thereof which is joined by a rotating hollow bearing 38 to a stationary inlet tube 39 through which washing water can be introduced into the interior chamber 37 for delivery into the interior of the drum 12 at a position close to the narrow end thereof by means of a set of radial arms 39.

In use of the separator described hereinabove a slurry of solids and liquids to be separated is introduced through the open end 35 of the hollow central member 23 and circumferentially accelerated by the radial arms 33 as it is delivered to a point close to the inner surface of the drum 12 at the outlets of the arms 33. The slurry is spread by the centrifugal action of the drum 12 into a relatively thin film with the solids fraction being urged radially into contact with the lining 18 of the drum whilst the liquid flows over this at a radially inner position towards the wide end 14 from which it overflows into the launder 17.

The scraper blades 28 are staggered axially in relation to the axial position of scraper blades on adjacent blade support bars 24 so that the axial movement of the solids fraction towards the wide end 14 during the periods between successive contact by blades 28 is compensated so that an individual particle displaced by one blade 28 towards the narrow end 13 of the drum is moved further towards the narrow end of the drum whilst in contact with the blade than the reverse movement which it makes in the period between its contact with the first blade and its next contact with a corresponding succeeding blade on the blade carrier bar 24 which follows it in sequence around the array. In this way the solids fraction is gradually urged towards the narrow end of the drum to be collected in a collection pan 40 for subsequent discharge in any known way. Because the scraper blades 28 are in direct contact with the smooth resistant surface of the lining 18 they do not have to exert a shearing action on the solids fraction but rather merely to collect the solids in the thin film and displace them all bodily axially towards the narrow end. Wear on the blades 28 is thus reduced as is the power consumption required to drive the apparatus. By using a relatively thin film and a shallow cone angle it is possible to operate the apparatus at a much lower speed of rotation than was hithertofore practicable therefore making it possible for the apparatus to be made lighter in weight and less robust than the very strong, highly engineered centrifugal separating apparatus of the prior art.

Figure 3:
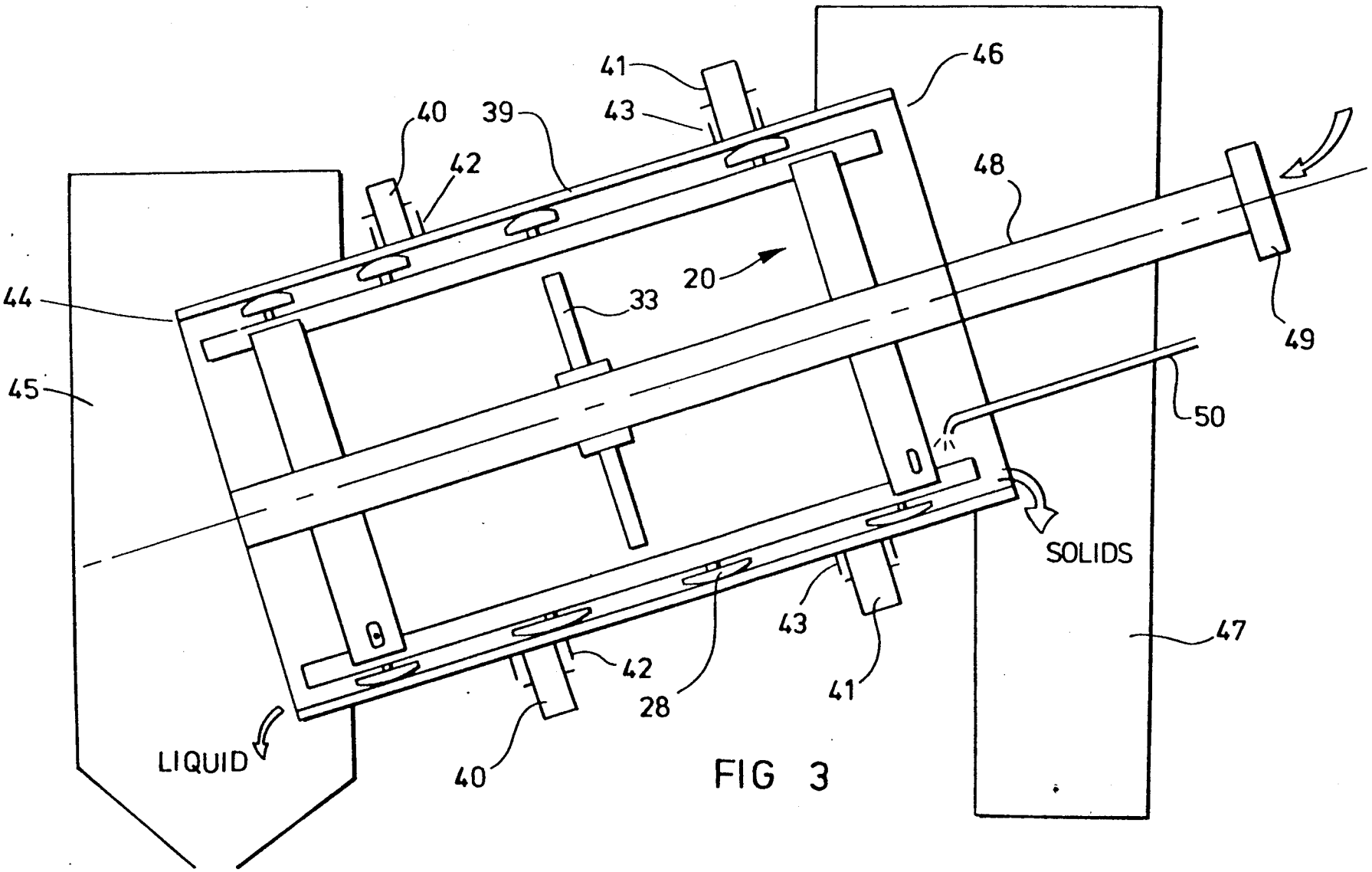
FIG. 3 is an axial sectional view through a further embodiment of the invention.

Even slower speeds than those discussed above may be used if the drum has no taper at all and FIG. 3 shows in schematic form the basic components of a separator using a right cylindrical drum. In FIG. 3 a parallel sided right-circular drum 39 is shown with its axis X—X inclined at a shallow angle in the region of a few degrees to the horizontal. The drum 39 is mounted for rotation about its axis X—X by means of two sets of external rollers 40, 41 one or both of which may be driven to drive the drum 39. The rollers 40, 41 are guided in respective peripheral channels 42, 43 which also serve to locate the drum axially. Surrounding the lower open end 44 of the drum 39 is a fluid collecting launder 45, and surrounding the upper open end 46 of the drum 39 is a solids collecting shroud 47.

Within the drum 39 is a hollow central axial shaft 48 carrying a scraper arrangement 20 which is in all respects identical to the scraper arrangement 20 in the embodiment of FIG. 1 except that the scraper bars 24 extend parallel to one another rather than being inclined. The central shaft 48 is rotatable by drive means (not shown) and a slurry of solids and liquids to be separated is introduced via a swivel connector 49 in a manner similar to the introduction of wash liquid through the swivel bearing 38 of the embodiment of FIG. 1. Radial arms 33 distribute the slurry to the inner surface of the drum 39 at a point approximately midway along its length.

The speed of rotation of the drum 39, driven by the rollers 40, is such that whilst the slurry is held against the surface of the drum by the centrifugal force the axial component of gravity urges the liquid fraction towards the lower end 44 where it is collected in the launder 45, whilst the solids are scraped by the scraper blades 28 which urge them progressively towards the upper end from which they are discharged into the shroud 47. Washing water to carry away fine particles of solids when the apparatus is used as a classifier, or to cleanse the solids of soluble contaminants when used as a solids-liquids separator may be introduced via one or a plurality of introduction ducts 50 the outlet ends of which may be provided with spray nozzles or alternative suitable delivery outlets.

What is claimed is:

1. A centrifugal solids-liquids separator comprising:

a rotatable hollow centrifuge drum having a wider end and a narrower end, means for rotating said drum about its axis, means for introducing a slurry of solids and liquids to be separated at a point along the length of the drum spaced from said wider end thereof such that rotation of said drum tends to cause migration of said slurry towards the said wider end thereof, scraper conveyor means rotatable about an axis coincident with that of said drum and at a relative speed which is low in relation to the absolute speed of the drum, said scraper conveyor means including a plurality of individual scraper blades, and means mounting said scraper conveyor means such that the individual scraper blades thereof are radially displaceable with respect of the inner surface of the drum such that they act in direct contact with the inside surface of said drum to displace solids particles contacted thereby towards said narrow end of said drum against the axial force induced on them by rotation of said drum, the said scraper blades carrying additional weights for increasing the radial force exerted thereby during rotation.

2. The centrifugal solids-liquids separator of claim 1, wherein said scraper blades are rockably mounted about an axis generally perpendicular to a radial plane including the axis of rotation of said scraper conveyor means and passing through the point of connection of the blade to a blade carrier member.

3. The centrifugal solids-liquids separator of claim 1, wherein said scraper blades comprise a rigid blade body and a resiliently flexible blade member having a drum-contacting surface.

4. The centrifugal solids-liquids separator of claim 1, wherein said rotatable drum has a tapered part between said wider end thereof and said narrower end thereof, said tapered part having a shallow cone angle, less than 2° and said wider end of said drum having no weir lip such that slurry introduced into said drum whilst it is rotating is formed into a thin film by the centrifugal forces acting thereon.

5. The centrifugal solids-liquids separator of claim 1, wherein said drum has a lining of wear-resistant material.

6. The centrifugal solids-liquids separator of claim 5, wherein said drum lining has a smooth inner surface.

7. The centrifugal solids-liquids separator of claim 5, wherein said drum lining is cast in-situ by rotating said drum whilst holding its axis at a shallow angle to the horizontal.

8. The centrifugal solids-liquids separator claim 1, wherein there is further provided a radial slurry delivery duct acting to cause circumferential acceleration of slurry as it is introduced to the inside surface of the drum.

9. A centrifugal solids-liquids separator comprising:

a rotatable hollow centrifuge drum having a wider end and a narrower end, means for rotating said drum about its axis, means for introducing a slurry of solids and at least one liquid to be separated at a point along the length of the drum spaced from said wider end thereof such that rotation of said drum tends to cause migration of said slurry towards the said wider end thereof, scraper conveyor means rotatable about an axis coincident with that of said drum and at a relative speed which is low in relation to the absolute speed of the drum, said scraper conveyor means including a plurality of individual scraper blades, and means mounting said scraper blades such that they act in direct contact with the inside surface of said drum to displace solids particles contacted thereby towards said narrow end of said drum against the axial force induced on them by rotation of said drum, said mounting means including a plurality of radial arms and a plurality of axially extending scraper blade carriers, means connecting said scraper blade carriers to said radial arms, said connecting means allowing said scraper blade carriers a limited radial displacement with respect to said radial arms, and means individually rockably mounting the individual scraper blades to the said axially extending scraper blade carriers.

10. The centrifugal solids-liquids separator of claim 9, wherein said scraper blades are rockably mounted about an axis generally perpendicular to a radial plane including the axis of rotation of said scraper conveyor means and passing through the point of connection of the individual scraper blade to the said blade carrier.

11. The centrifugal solids-liquids separator of claim 9, wherein said scraper blades carry additional weights for increasing the radial force exerted thereby during rotation.

12. The centrifugal solids-liquids separator of claim 9, wherein said scraper blades comprise a rigid blade body and a resiliently flexible blade member having a drum-contacting surface.

13. The centrifugal solids-liquids separator of claim 9 wherein said rotatable drum has a tapered part between said wide end thereof and said narrower end thereof, said tapered part having a shallow cone angle, less than 2° and said wider end of said drum having no weir lip such that slurry introduced into said drum whilst it is rotating is formed into a thin film by centrifugal forces acting thereon.

14. The centrifugal solids-liquids separator of claim 9 wherein said drum has a lining of wear-resistant material.

15. The centrifugal solids-liquids separator of claim 14, wherein said drum lining has a smooth inner surface.

16. The centrifugal solids-liquids separator of claim 9, wherein there is further provided a radial slurry delivery duct acting to cause circumferential acceleration of slurry as it is introduced to the inside surface of the drum.

* * * * *